United States Patent [19]

Tanikawa et al.

[11] Patent Number: 4,857,432

[45] Date of Patent: Aug. 15, 1989

[54] TONER FOR DEVELOPING ELECTROSTATIC CHARGE IMAGE

[75] Inventors: Hirohide Tanikawa, Kawasaki; Toshiaki Nakahara, Tokyo; Keita Nozawa, Yokohama, all of Japan

[73] Assignee: Canon Kabushiki Kaisha, Tokyo, Japan

[21] Appl. No.: 194,173

[22] Filed: May 16, 1988

[30] Foreign Application Priority Data

May 18, 1987 [JP] Japan ..... 62-118882
May 18, 1987 [JP] Japan ..... 62-118883

[51] Int. Cl.[4] ..... G03G 9/08

[52] U.S. Cl. ..... 430/106; 430/106.6; 430/110

[58] Field of Search ..... 430/110, 106, 106.6

[56] References Cited

U.S. PATENT DOCUMENTS 4,230,787 11/1980 Watanabe et al. ..... 430/106.6

FOREIGN PATENT DOCUMENTS 43-27596 11/1968 Japan ..... 430/106
49-27229 3/1974 Japan ..... 430/106
55-135854 11/1980 Japan ..... 430/110
59-50449 3/1984 Japan ..... 430/106

*Primary Examiner*—Paul R. Michl
*Assistant Examiner*—Jeffrey A. Lindeman
*Attorney, Agent, or Firm*—Fitzpatrick, Cella, Harper & Scinto

[57] ABSTRACT

A toner for developing electrostatic latent images, comprises:
100 parts by weight of a binder resin;
20 to 200 parts by weight of magnetic powder; and
0.01 to 10 parts by weight of a compound represented by the following formula wherein A is a phenylene group, which may have a substituent selected from a nitro group, a halogen atom, an alkoxy group having 1 to 18 carbon atoms, an alkyl group having 1 to 18 carbon atoms, an alkenyl group having 2 to 18 carbon atoms, an aralkyl group having 7 to 18 carbon atoms or an aryl group having 6 to 18 carbon atoms; B is a phenylene group or a naphthylene group which may have a substituent selected from a nitro group, a halogen atom, a carboxyl group, an anilide group, an alkoxy group having 1 to 18 carbon atoms, a carboxyester group having 2 to 18 carbon atoms, an alkyl group having 1 to 18 carbon atoms, an alkenyl group having 2 to 18 carbon atoms, an aralkyl group having 7 to 18 carbon atoms or an aryl group having 6 to 18 carbon atoms; X and Y each are —O—, —COO—, —S— or where R is hydrogen or an alkyl having 1 to 4 carbon atoms; M represents scandium, vanadium, manganese or zinc; C represents hydrogen, sodium, potassium, ammonium or organic ammonium; with the proviso that when A or B has plural substituents, they may be either the same or different.

32 Claims, No Drawings

TONER FOR DEVELOPING ELECTROSTATIC CHARGE IMAGE

BACKGROUND OF THE INVENTION

1. Field of the Invention

This invention relates to a toner for developing electrostatic charge latent images in the electrophotographic method or the electrostatic recording method.

2. Related Background Art

In toners for developing electrostatic charge images, since it is difficult to obtain stable chargeability with the binder resin alone used therefor, it has been practiced to add a charge controllable substance such as a dye or a pigment for controlling the toner to desired triboelectric chargeability.

As the compound for controlling the positive charging of the toner practically applied to this field of art, there is a nigrosine type dye. On the other hand as the compound for controlling negative chargeability of the toner, there may be included metal containing compounds as disclosed in Japanese Patent Publication Nos. 45-26478 and 55-42752. These compounds have excellent characteristics among the charge controllable substances proposed in the prior art with respect to the performance of imparting charges to toner particles, and could provide a toner capable of giving practically satisfactory images in as copying machine or a page printer under ordinary environmental conditions.

However, under the progress of personalization, speed acceleration, multifunctionalization in image forming devices according to the electrophotographic method or the electrostatic recording method, it has been demanded to have a toner which has more excellent environmental stability, good durability stability and can give an image having high image density without fog, enriched in resolving power with sharp contrast and also excellent in gradation reproducibility. Various developing method, including not only the positive developing method, the analog developing method, but also the reversal developing, the digital developing, the low potential developing have been used.

With miniturization and personalization, toners are used increasingly in places where there is no air conditioning under high temperature and high humidity in tropical districts or under low temperature and low humidity in inland districts, and must give stably images of high quality even under severe environment. Further, with acceleration of speed, images of high quality must be provided stably, while standing use of a large amount of the toner at one time and continuous use over a long term.

The performance demanded for the toner is not only developability, but various starting materials have been employed for improving fixing characteristics, off-set resistance, cleaning characteristics, antiblocking characteristics. With such improvements, the trielectric charges on the material are greatly changed and the function of the charge controlling agent is not satisfactory only with the function of enhancing the charges of the toner, but it has been demanded to "control" constantly the charged amount of the toner.

Under such situation, the image forming method employing a magnetic toner containing magnetic powder in the toner has been frequently used. With the progress of such technique, it has been desired to have a magnetic toner having well controlled chargeability.

SUMMARY OF THE INVENTION

An object of the present invention is to provide a toner which can give a stable tone image without influence from changes in environment such as temperature change, humidity change.

Another object of the present invention is to provide a toner which is excellent in durability and can give a constantly stable image even in continuous use for a long term.

A further object of the present invention is to provide a toner which gives a toner enriched in resolving power and fine line reproducibility.

Still another object of the present invention is to provide a toner which is constantly high in density and without fog.

A still further object of the present invention is to provide a toner which is capable of forming a toner image revealing densely fine image and revealing sharply an image such as graphic image.

Still another object of the present invention is to provide a toner which can apply to both low speed machine and high speed machine.

A still further object of the present invention is to provide a toner without lowering in performance even when left to stand for a long term.

According to the present invention, there is provided a toner for developing electrostatic latent images, comprising:

100 parts by weight of a binder resin ingredient;

20 to 200 parts by weight of magnetic powder; and 0.01 to 10 parts by weight of a compound represented by the following formula:

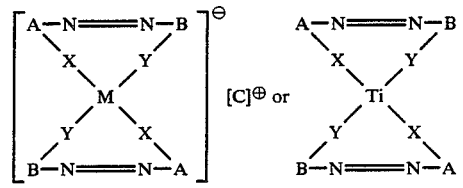

wherein A represents phenylene group, which may have nitro group, halogen atom, alkoxy group having 1 to 18 carbon atoms, alkyl group having 1 to 18 carbon atoms, alkenyl group having 2 to 18 carbon atoms, aralkyl group having 7 to 18 carbon atoms or aryl group having 6 to 18 carbon atoms as the substituent; B represents phenylene group, naphthylene group which may have nitro group, halogen atom, carboxyl group, anilide group, alkoxy group having 1 to 18 carbon atoms, carboxyester group having 2 to 18 carbon atoms, alkyl group having 1 to 18 carbon atoms, alkenyl group having 2 to 18 carbon atoms, aralkyl group having 7 to 18 carbon atoms or aryl group having 6 to 18 carbon atoms as the substituent; X and Y each represent —O—, —COO—, —S— or

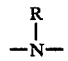

(R is hydrogen or alkyl having 1 to 4 carbon atoms; M represents scandium, vanadium, manganese or zinc; C represents hydrogen, sodium, potassium, ammonium or organic ammonium; with proviso that when A or B has plural substitutents, they may be either the same or different.

DETAILED DESCRIPTION OF THE INVENTION

The present inventors have studied intensively about a magnetic toner which is stably charged negatively even under environment of either normal temperature and normal humidity, lower temperature and lower humidity or higher temperature and higher humidity, and gives stable images for a long term, and consequently found that the magnetic toner containing the compound represented by the above formula is particularly excellent. The present invention has been accomplished by finding that the compound represented by the above formula to be used in the present invention is stable with lapse of time, little in moisture absorption and, when contained in a magnetic toner, is a charge controlling agent of good quality which can give a toner with excellent electrophotographic characteristics even under low humidity.

Further, it has been also found that said compound is a charge controlling agent which is little inhibited in charge controllability by magnetic powder and other colorants such as pigments or dyes, when employed together with such materials.

These compounds represented by the above formula to be used in the present invention has good dispersibility into a resin, and the toner contained is stable in triboelectric charges between magnetic particles, between magnetic toner and carrier and between magnetic toner and toner carrier such as sleeve including magnetic field generating means, and also sharp and uniform in distribution of triboelectric charges, and can be easily controlled to triboelectric charges suitable for the developing system used.

As the method for imparting said compound to the toner, there are the method added internally of the toner and the method externally added, but the method internally added is preferably with respect to durability and stability. The amount of these comounds may be determined depending on the kind of the binder resin, presence or absence of additives optionally added, the toner preparation method including the dispersing method, and is not limited to one kind, but it is used in the range of 0.1 to 10 parts by weight, preferable 0.1 to 5 parts by weight per 100 parts of the binder resin.

The preferable compounds according to the present invention are represented by the following formulae (I) to (VI). Among these compounds, titanium complex compounds are preferred with respect to successive copying of a large number of sheets under the conditions of low temperature and low humidity.

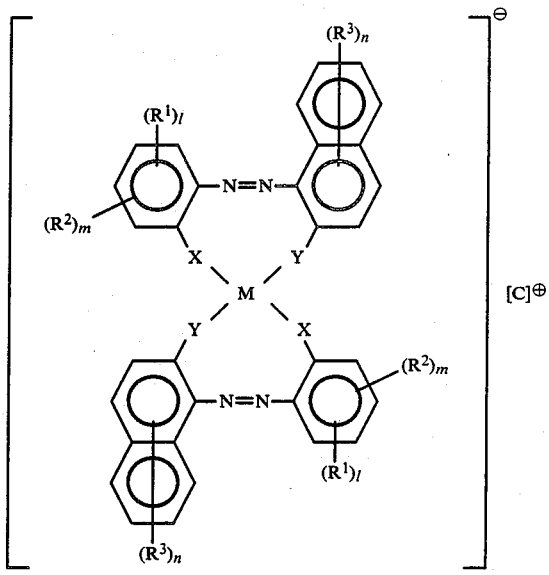

(I)

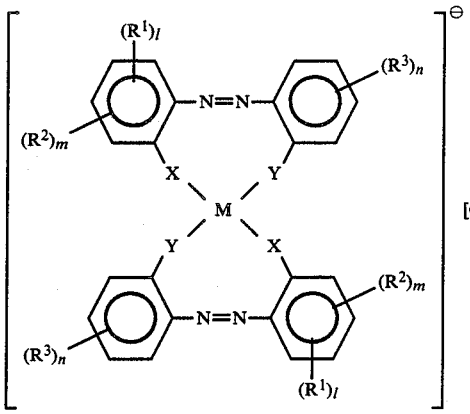

(II)

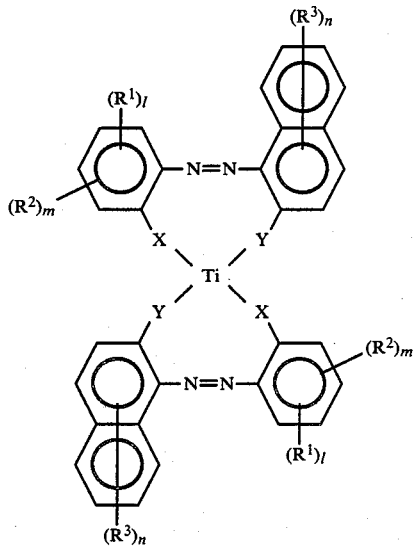

(III)

-continued

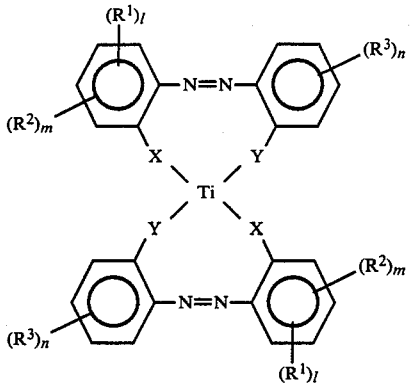

(IV)

[In the formulae (I) to (IV), R1 represents alkyl group having 1 to 18 carbon atoms, alkenyl group having 2 to 18 carbon atoms, aralkyl group having 7 to 18 carbon atoms or aryl group having 6 to 18 carbon atoms; $R^2$ represents hydrogen, halogen, nitro, or alkoxy having 1 to 18 carbon atoms; $R^3$ represents hydrogen, halogen, nitro, carboxyl, anilide or alkyl having 1 to 18 carbon atoms, alkenyl group having 2 to 18 carbon atoms, aralkyl group having 7 to 18 carbon atoms, aryl group having 6 to 18 crbon atoms, alkoxy group having 1 to 18 carbon atoms or carboxyester group having 2 to 18 carbon atoms; X and Y each represent —O—, —COO—, —S— or —$NR^4$ ($R^4$ is alkyl having 1 to 4 carbon atoms); M represents scandium, vanadium, manganese or zinc; C represents hydrogen, sodium, potassium, ammonium or organic ammonium; 1 represents 1 or 2; m and n each represent 1, 2 or 3; with proviso that when having plural substituents, they may be either the same or different.]

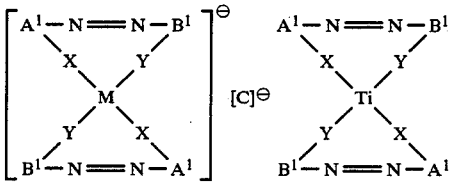

(V) (VI)

[In the formulae (V) and (VI), $A^1$ represents phenylene group, which may have nitro group, halogen atom or alkoxy group having 1 to 18 carbon atoms as the substituent; $B^1$ represents phenylene residue or naphthylene residue which may have nitro group, halogen atom, carboxyl group, anilide group or alkoxy group having 1 to 18 atoms or carboxyl ester as the substituent; X and Y each represent —O—, —COO—, —S— or —NR— (R is hydrogen or alkyl having 1 to 4 carbon atoms); M represents scandium, vanadium, manganese or zinc; C represents hydrogen, sodium, potassium, ammonium or organic ammonium; with proviso that when having plural substituents, they may be either the same or different.]

Said compound to be used in the present invention can be obtained by treating an azo compound capable of forming a metal complex with a metal imparting agent.

In the above formulae, A should preferably have an alkyl group having 1 to 8, preferably 4 to 8 carbon atoms, with respect fo dispersibility in the binder resin. With respect to negative triboelectric chargeability, A should preferably have chlorine atom or nitro group.

For example, 4-methyl-6-chloro-2-aminophenol is diazotized, coupled with β-naphthol, treated with an inorganic manganese salt and then filtered at pH 3 or lower, and the precipitates are washed to pH 6 to 7, whereby the compound No. 1 is obtained. Counter-ions can be varied by the subsequent treating conditions.

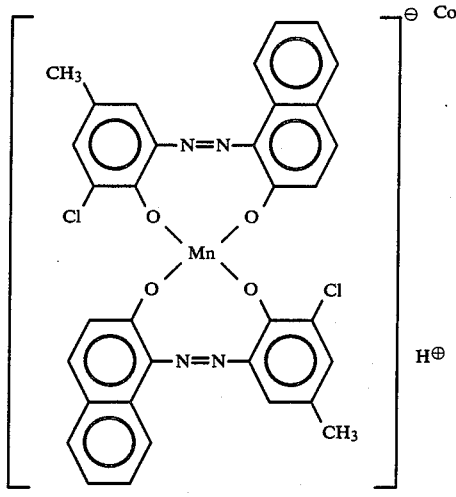

Compound No. 1

Other specific examples of the compounds to be used in the present invention may include, for example, the following compounds, which can be synthesized according to similar methods.

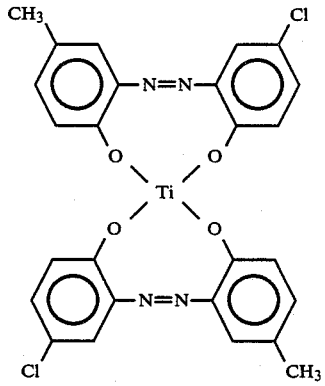

Compound No. 2

-continued
Compound No. 3
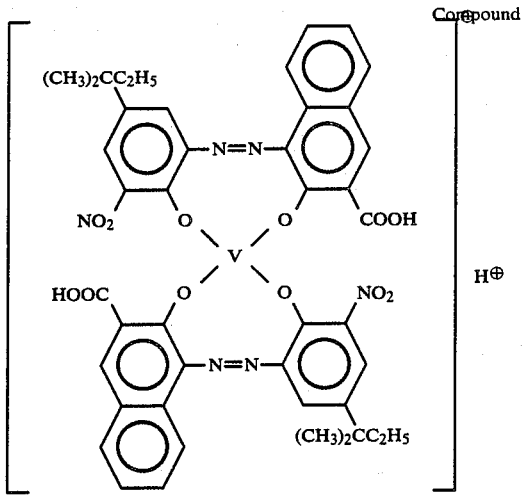
Compound No. 4
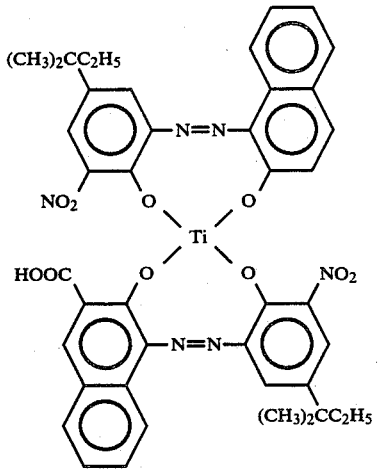
The following compound No. 6 is obtained by diazotizing 2-aminophenol, followed by coupling with phenol, treating the product with an inorganic manganese salt and filtering the treated product at pH 3 or lower, and then washing the precipitates to pH 6–7.
Compound No. 5
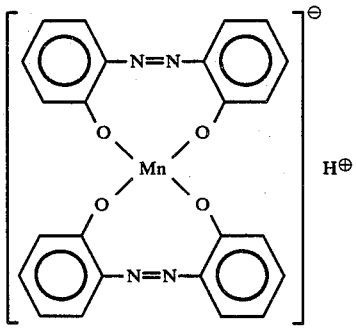
-continued
Compound No. 6
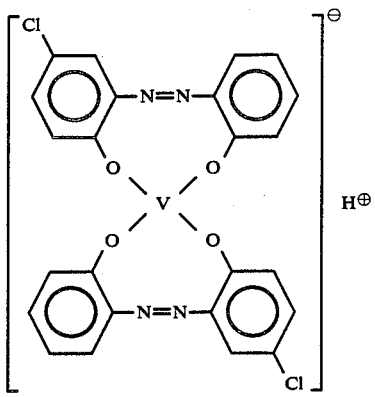
Compound No. 7
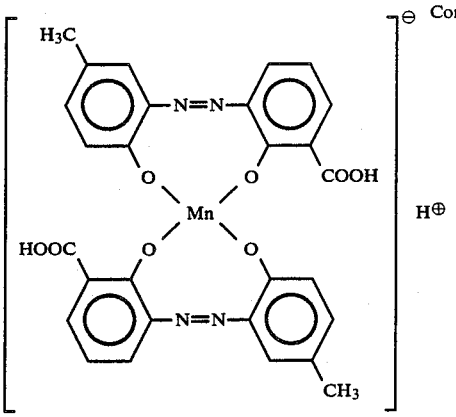
Compound No. 8
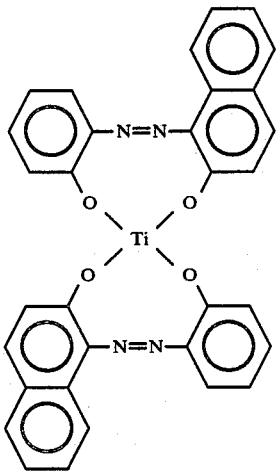

-continued

Compound No. 9

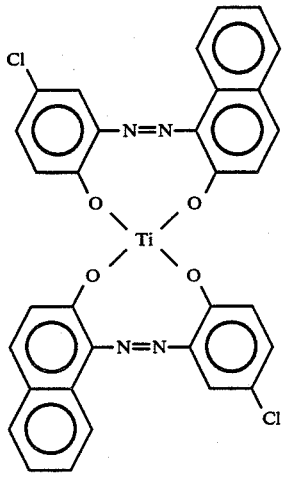

Comparative Compound No. 1

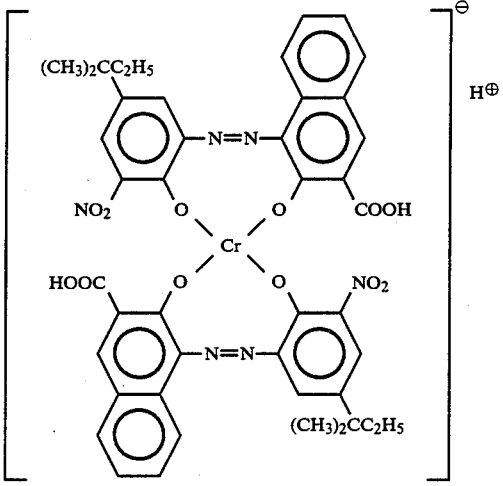

Comparative Compound No. 2

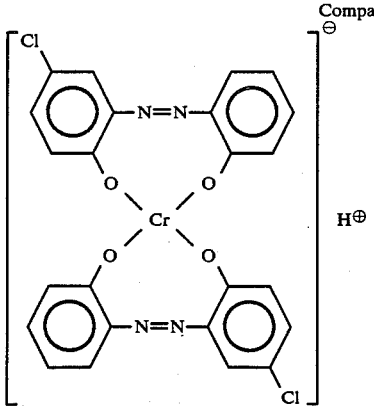

-continued

Comparative Compound No. 3

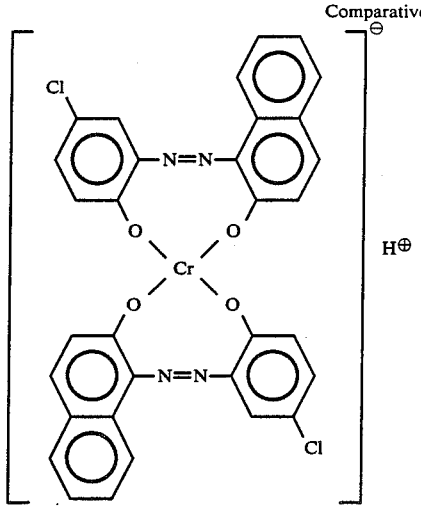

In the present invention, charge controlling agents known in the art may be also employed, if they do not exert deleterious influences.

In the magnetic toner of the present invention, any desired suitable pigment may be also added. For example, there may be employed dyes or pigments such as carbon black, iron black, Phthalocyanine Blue, Ultramarine, quinacridone, Benzidine Yellow, etc.

The binder resin to be used in the present invention may include homopolymers or copolymers of vinyl type compounds shown below: styrene and derivatives thereof such as styrene, o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene; ethylenically unsaturated monoolefins such as ethylene, propylene, butylene, isobutylene; unsaturated polyolefins such as butadiene; vinyl halides such a vinyl chloride, vinylidene chloride, vinyl bromide, vinyl fluoride; vinyl esters such as vinyl acetate, vinyl propionate, vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, phenyl acrylate; vinyl ethers such as vinyl methyl ether, vinyl ethyl ether, vinyl isobutyl ether; vinyl ketones such as vinyl methyl ketone, vinyl hexyl ketone, methyl isopropenyl ketone; N-vinyl compounds such as N-vinylpyrrole, N-vinylcarbazole, N-vinylindole, N-vinylpyrrolidone; vinylnaphthalenes; acrylic acid or methacrylic acid derivatives such as acrylonitorile, methacrylonitorile, acrylamide; vinyl compound derivatives having carboxyl group as acrylic acid, methacrylic acid, maleic acid, fumaric acid; half esters such as maleic acid half ester, fumaric acid half ester; maleic anhydride, maleic acid ester, fumaric acid derivatives.

Further, as other binder resins, polyester, polyurethane, epoxy resin, polyvinyl butyral, rosin, modified rosin, terpene resin, phenol resin, aliphatic or alicyclic hydrocarbon resin, aromatic petroleum resin, haloparaffin, paraffin wax may be included. These can be used either singly or as a mixture.

With respect to off-set resistance to hot rollers and developing characteristics, a styrene copolymer crosslinked with a crosslinking agent such as divinylbenzen is preferred. Particularly, a styrene-α-methylene aliphatic monomer carboxylic acid alkyl ester-divinylbenzene copolymer or a styreneacrylic acid alkyl ester-divinylbenzene copolymer is preferred as the binder resin.

As the binder resin for toner to be provided for the pressure fixing system, low molecular weight polyethylene, low molecular weight polypropylene, ethylene-vinyl acetate copolymer, ethylene-acrylic acid ester copolymer, higher fatty acids, polyamide resin or polyester resin can be used either singly or as a mixture.

The magnetic toner of the present invention, when used as the two-component developer, is used as a mixture with carrier powder. As the carrier which can be used in the present invention, powder having magnetic properties such as ferrite powder, nickel powder, glass beads and these treated on the surface by coating with a resin may be included.

As the magnetic material to be contained in the magnetic toner of the present invention, there may be included iron oxide such as magnetite, maghemaite, ferrite, and other iron oxides containing other metal oxides; meals such as Fe, Co, Ni, or alloys of these metals with metals such as Al, Co, Cu, Pb, Mg, Ni, Sn, Zn, Sb, Be, Bi, Cd, Ca, Mn, Se, Ti, W, V, and mixtures thereof. These ferromagnetic materials should preferably have an average particle diameter of 0.1 to 2 μm, and magnetic characteristics by application of 10K Oersted (Oe) of a coercive force of 20 to 150 Oersted (Oe), a saturated magnetization of 50 to 200 emu/g (preferably 50 to 100 emu/g), a residual magnetization of 2 to 20 emu/g. The amount contained in the toner may be 20 to 200 parts by weight, particularly preferably 40 to 150 parts by weight, per 100 parts by weight of the resin component.

The toner of the present invention may be also mixed with an additive, if desired. As the additive, there are lubricants such as Teflon, polyvinylidene fluoride, fatty acid metal salts; abrasives such as cerium oxide, strontium titanate, silicon carbide; flow property imparting agent or caking preventive such as colloidal silica, alumina; electroconductivity imparting agent such as carbon black, tin oxide; fixing agent such as low molecular weight polyethylene. Particularly, in case the toner of the present invention is used as one-component developer, it is preferable for improvement of triboelectric chargeability with the sleeve to use fine particles of hydrophobic colloidal silica with a BET specific surface area according to the nitrogen gas adsorption method of 70 to 300 $m^2/g$ mixed in the toner in an amount of 0.1 to 3% by weight based on the weight of toner. For the purpose of improving mold release property during hot roll fixing, about 0.5 to 5% by weight of a waxy substance such as low molecular weight polyethylene, low molecular weight polypropylene, low molecular weight propylene-ethylene copolymer, microcrystalline wax, carunauba wax, sazol wax, etc may be also added.

As the method for preparing the toner according to the present invention, there is the method in which the constituent materials are thoroughly mixed by a mixer such as ball mill, then kneaded by use of a melting kneading machine such as hot rolls, kneader or extruder and, after cooling and solidification, crushed and classified to obtain the toner. Further, there is the spray drying method in which the constituent materials are dispersed in a binder resin solution and thereafter the dispersion is dried by spraying. Further, there is the polymerization toner preparation method in which predetermined materials are mixed in a monomer which should constitute the binder resin to form a suspension, followed by polymerization, to obtain the toner. Further, in microcapsule toner having core and shell, the method of incorporating predetermined materials in a core or a shell material or both can be applied.

In the present invention, the volume average particle size of the magnetic toner particle may be 3 to 20 μm, preferably 4 to 15 μm. In the present invention, the volume average particle size of the toner is measured by means of Coulter Counter TA-II Model (produced by Coulter Co.), to which N interface outputting number distribution and volume distribution (produced by Nikkaki) and CX-1 personal computer (produced by Canon) are connected, and an electrolyte of first grade sodium chloride is used to prepare an aqueous 1% NaCl solution. As the measuring method, into 100 to 150 ml of the above electrolyte aqueous solution is added 0.1 to 5 ml of a surfactant, preferably alkylbenzenesulfonate, and further 2 to 20 mg of a sample to be measured is added. The electrolyte containing the sample dispersed therein is subjected to dispersing treatment by a sonication dispenser for about 1 to 3 minutes, and the particle size distribution of particles of 2 to 40 μ is measured with the number as the standard by the above Coulter Counter TA-II Model by use of 100 μ aperture. The value determined is the volume average particle size.

The toner of the present invention should preferably have an acid value of the soluble components of the toner in tetrahydrofuran of 50 or less, more preferably 25 or less. If the acid value of the soluble components of the toner is not higher than the above value, the charge controlling action of the compound to be used in the present invention can function most effectively, exhibiting more excellent developability, whereby an image of high quality can be given. If the acid value exceeds 50, excessive charges may be effected under low humidity to lower developability.

The value of acid value in the present invention is a numerical value represented in mg of potassium hydroxide necessary for neutralizing 1 g of a sample, and measured as follows. A solution of 2 g of soluble components dissolved in 200 g of a solvent mixture of toluene/ethanol=2/1 is titrated with 0.1N potassium hydroxide solution with phenolphthalein as the indicator.

In the toner for thermal fixing according to the present invention, the tetrahydrofuran soluble components of the toner should preferably have a number average molecular weight (Mn) of 2,000 to 20,000 and a weight average molecular weight of 50,000 to 5,000,000, preferably 50,000 to 3,000,000, with the Mw/Mn ratio being 10 or higher, preferably 30 to 200.

In the present invention, the values of Mw and Mn are calculated from the values measured by gel permeation chromatography. The measurement is conducted by flowing tetrahydrofuran as the solvent at a flow rate of 1 ml per minute at a temperature of 25° C., and injecting 0.5 ml of a sample solution containing 8 mg/ml of a sample in tetrahydrofuran. As the column, it is preferable to combine a plurality of commercially available polystyrene gel columns for measuring adequately the molecular weight regions of $10^3$ to $2\times10^6$. For example, the combination of μ-Styragel 500, $10^3$, $10^4$, $10^5$ produced by Waters Co. or the combination of Shodex A-802, 803, 804, 805 produced by Showa Denko Co. is preferred. In molecular weight measurement of a sample, the molecular weight distribution possessed by the sample is calculated from the relationship between the logarithmic value of the calibration curve prepared from several kinds of mono-dispersed polystyrene standard samples and the count number. As the standard polystyrene samples for preparation of the calibration curve, for example, those of molecular weights of $6\times10^2$, $2.1\times10^3$, $4\times10^3$, $1.75\times10^4$, 5.1×104, 1.1×105, 3.9×105, 8.6×105, 2×106, $4.48\times10^6$ produced by Pressure Chemical Co. or Toyo Soda Kogyo Co. may be employed, and at least about 10 kinds of standard polystyrene samples may be appropriately employed. For the detector, a RI (reractory indec) detector is used.

Further, in the toner for thermal fixing kneaded and pulverized, when the tetrahydrofuran insolubles of the resin component in the toner is 70% by weight or less, preferably 10 to 60% by weight, more preferably 10 to 50% by weight, the compound to be used in the present invention can be well dispersed in the toner to exhibit effectively the charge controlling action. If the tetrahydrofuran insolubles is less than 10% by weight, the compound to be used in the present invention is poorly dispersed, whereby variance appears in the toner particles to give inferior durability and sometimes the problems such as lowering in density during usage or occurrence of fog may be caused. If it is over 70% by weight, there are such problems that fixing badness may occur or that kneading is not sufficiently effected when using the kneading method. With respect to fixing characteristics, the binder resin should preferably contain 30 to 90% by weight of tetrahydrofuran soluble components.

The tetrahydrofuran insolubles in the present invention refer to the ratio of the polymer portion which is insoluble in the solvent (tetrahydrofuran). The tetrahydrofuran insolubles are defined by the value measured as follows.

A certain amount (W 1 g) of a toner is weighed, extracted with Soxhlet's extractor by use of a cylindrical filter paper (No. 86R, produced by Toyo Roshi) to remove the soluble components in the polymer with the solvent, and further the sample remained without extraction is dried and weighed (W 2 g).

When the weight of the solid insoluble components such as magnetic material, silica contained in the toner is defined as W3, the tetrahydrofuran insolubles are calculated as:

$$\frac{W2 - W3}{W1 - W3} \times 100\%$$

Specifically, 0.5 to 1.0 g of a toner sample is weighed, placed in a cylindrical filter paper, applied to Soxhlet's extractor, and extracted for 6 hours with the use of 100 to 200 ml of THF as the solvent.

The present invention is described in more detail by referring to the following Examples, but the present invention is not limited to these Examples. Parts in the following formulations are parts by weight.

In Examples and Comparative examples, the charges and the weight of the toner layer per unit area in the developing region on the toner carrier (sleeve) were determined by use of the absorption system Faraday gauge method. The absorption system Faraday gauge system method comprises urging its outer cyinder against the toner carrier to absorb substantially all of the toners on a certain area of the carrier to collect the toners into the inner cylinder filter, and the weight of the toner layer per unit area on the toner carrier can be calculated from the weight gain of the filter. At the same time, by measuring the charges accumulate in the inner cylinder shielded electrostatically from the outside, charges per unit area and per unit weight on the toner carrier can be determined. (The absorption system Faraday gauge method is introduced in, for example, Journal of Electrophotographic Society of Japan, Vo. 11, No. 1, etc.)

EXAMPLE 1

Styrene-butyl acrylate-divinylbenzene copolymer (monomer weight ratio 70/30/1): 100 parts
Magnetic iron oxide (average particle size about 0.2 μm): 60 parts
Compound No. 4 (average particle size: about 4 μm): 2 parts
Low molecular weight polypropylene: 3 parts, After the above materials were preliminarily mixed, the mixture was kneaded on two rolls heated to 150° C., and after cooling coarsely crushed by a cutter mill and pulverized by a pulverizer by use of jet air stream, and further classified by use of a wind force classifier to obtain fine powder with a volume average particle size of 11 μm having negative triboelectric chargeability. This was called magnetic toner No. 1, and 100 parts of the magnetic toner No. 1 were well mixed with 0.4 parts of hydrophobic colloidal silica having negative triboelectric chargeability (BET surface area: 200 $m^2/g$) to obtain a developer No. 1. The physical properties of the toner No. 1 and the developer No. 1 are shown in Table 2.

By use of the toner, copying test was performed under ordinary environment in a copying machine with copying speed of 50 sheets of A4 size papers per minute (trade name NP-7550, produced by Canon) to obain an image of high quality faithful to the original. As the result of copying test repeated for 50,000 sheets, good images could be obtained stably during the test, and the density was maintained at 1.3 to 1.4, without fog recognized, and also reproduction of thin letter was excellent without narrowing of line observed. Further, similar results were obtained under low temperature and low humidity of 15° C. and 10% RH, and under high temperature and high humidity of 30° C. and 85% RH.

The charged quantity was measured by blow-off (TB-200, produced by Toshiba Chemical Co.) after 1 g of the developer No. 1 and 9 g of the iron powder carrier (200/300 mesh) were accurately weighed and thoroughly mixed.

COMPARATIVE EXAMPLE 1

In the same manner as in Example 1 except for using Comparative compound No. 1 in place of the Compound No. 4, Comparative toner No. 1 with a volume average particle size of 11 μm was prepared. By mixing 100 parts of Comparative toner No. 1 and 0.4 parts of said hydrophobic colloidal silica, Comparative developer No. 1 was prepared.

By use of the developer No. 1 in Example 1 and Comparative developer No. 1 in Comparative example 1, continuous copying tests were conducted under the environmental conditions of low temperature and low humidity (temperature 15° C. humidity 10% RH). The results are shown below in Table 1.

TABLE 1

| | Copied sheet number | | | | | |
|---|---|---|---|---|---|---|
| | Initial | | 100 sheets | | 1,000 sheets | |
| | Triboelectric/ Charges/ (μc/g) | Image Density | Triboelectric/ Charges/ (μc/g) | Image Density | Triboelectric/ Charges/ (μc/g) | Image Density |
| Inventive Developer No. 1 | −7/ | 1.35 | −7/ | 1.30 | −8/ | 1.30 |
| Comparative Developer No. 1 | −8/ | 1.35 | −10/ | 1.15 | −11/ | 1.10 |

The triboelectric charges in the above Table are triboelectric charges in the developer on the sleeve in the developing region at the developing instrument in the copying machine.

As is apparent from the results in the Table, the developer No. 1 of the present invention is stable in triboelectric charges of the developer on the sleeve under low temperature and low humidity environment, and therefore small in fluctuation of the image density. In contrast, in the case of Comparative developer No. 1, when the number of copying papers becomes greater, triboelectric charges of the developer on the sleeve are increased, whereby toner can be migrated from the sleeve to the photosensitive drum, resulting in lowering of image density.

EXAMPLE 2

Styrene-butyl acrylate-divinylbenzene copolymer (monomer weight ratio 70/30/1): 100 parts
Magnetic iron oxide (average particle size: about 0.2 μm): 60 parts
Compound No. 1 (average particle size: about 4 μm): 2 parts
Low molecular weight polypropylene: 3 parts.

After the above materials were preliminarily mixed, the mixture was kneaded on two rolls heated to 150° C., and after cooling coarsely crushed by a cutter mill and pulverized by a pulverizer by use of jet air stream, and further classified by use of a wind force classifier to obtain fine powder with a volume average particle size of 11 μm (magnetic toner No. 2), and 100 parts of the magnetic toner No. 2 were well mixed with 0.4 parts of hydrophobic colloidal silica to obtain a developer No. 2. The physical properties of the toner No. 2 and the developer No. 2 are shown in Table 2.

By use of the developer, copying test was performed under ordinary environment in a copying machine (trade name NP-7550, produced by Canon) to obtain an image of high quality faithful to the original. As the result of copying test repeated to 50,000 sheets, good images could be obtained stably during the test, and the density was maintained at 1.3 to 1.4, without fog recognized. Although the developer No. 2 had good developing characteristics even under low temperature and low humidity environment, it was slightly inferior in durability as compared with the developer No. 1 in Example 1.

EXAMPLE 3

Styrene-butylmethacrylatemonobutyl maleate-divinylbenzene copolymer (monomer weight ratio=80/15/5/0.6): 100 parts
Magnetic iron oxide (average particle size: about 0.2 μm): 60 parts
Compound No. 3 (average particle size: about 4 μm): 1 parts
Low molecular weight polypropylene: 3 parts.

According to the same method as in Example 2 except for using the above materials, a magnetic toner No. 3 with a volume average particle size of 12 μm was obtained by means of an extruder as the kneading device. By mixing 100 parts of the magnetic toner No. 3 and 0.4 parts of said hydrophobic collodial silica, a developer No. 3 was prepared. The physical properties of the toner No. 3 and the developer No. 3 are shown in Table 2.

When printout test was conducted by a commercially available laser beam printer (trade name LBP-CX, produced by Canon), high resolution images were obtained. As the result of repeated printing of 3,000 sheets, the density was maintained at 1.30 to 1.40, without fog recognized. Further, according to similar tests under the respective environments of 15° C., 10% RH and 35° C., 80% RH, excellent images were obtained similarly under the ordinary environment.

COMPARATIVE EXAMPLE 2

According to the same method as in Example 2 except for using 2 parts of a monoazo compound chromium complex shown below in place of the compound No. 1, Comparative magnetic toner No. 2 with a volume average particle size of 11.5 μm was obtained:

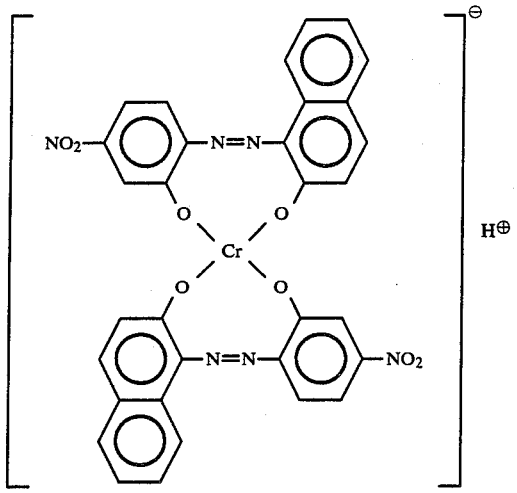

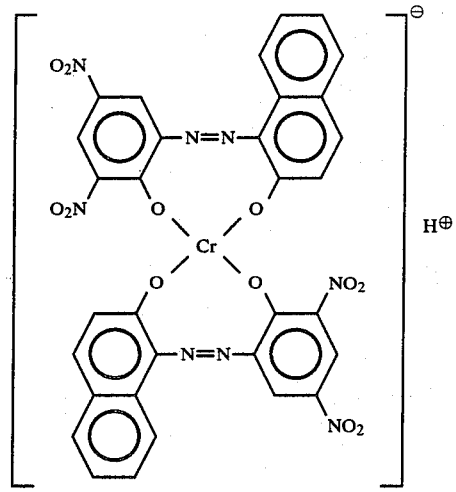

By mixing 100 parts of Comparative magnetic toner No. 2 and 0.4 parts of said hydrophobic colloidal silica, Comparative developer No. 2 was prepared. The physical properties of the magnetic toner No. 2 and Comparative developer No. 2 are shown in Table 2.

As the result of the copying test conducted similarly as in Example 2, good results were obtained up to 50,000 sheets, but the density was lower as compared with Example 2, namely 1.1 to 1.2. Further, under the environment of low temperature and low humidity of 15° C. and 10% RH, density was gradually lowered, until the density became 1.0 to 1.1 in copying after 20,000 sheets.

By mixing 100 parts of Comparative magnetic toner No. 3 and 0.4 part of the hydrophobic colloidal silica, Comparative developer No. 3 was prepared. The physical properties of comparative magnetic toner No. 3 and Comparative developer No. 3 are shown in Table 2.

As the result of the copying test conducted similarly as in Example 3, good images were obtained up to 3,000 sheets, but the density was lower as compared with Example 3, namely 1.2. Further, under the environment of 15° C. and 10% RH, density was unstable to be fluctuated between 1.1 and 1.3, and the image obtained was slightly fogged.

TABLE 2

| | Properties of Respective Toners and Developers | | | | | | | | |
|---|---|---|---|---|---|---|---|---|---|
| | | | | Magnetic Characteristic (10KOe) | | | | | |
| | Magnetic Toner No. | Tetrahydrofuran Insolveles (%) | A Valve | Coercive Force (Oe) | Saturation Magnetizat-tion (emu/g) | Residual Magnetiza-tion (emu/g) | Charged Amount (μC/g) | Molecular Weight Mn | Molecular Weight Mw |
| Example 1 | Magnetic Toner No. 1 | 32.1 | 1.1 | 132 | 30.3 | 5.9 | −11.5 | 6,000 | 200,000 |
| Example 2 | Magnetic Toner No. 2 | 31.5 | 1.2 | 134 | 30.5 | 5.8 | −12.7 | 6,000 | 200,000 |
| Example 3 | Magnetic Toner No. 3 | 19.4 | 12.5 | 128 | 29.4 | 4.8 | −12.8 | 7,000 | 180,000 |
| Comparative Example 1 | Comparative Magnetic Toner No. 1 | 31.7 | 1.3 | 133 | 31.1 | 5.7 | −13.6 | 6,000 | 200,000 |
| Comparative Example 2 | Comparative Magnetic Toner No. 2 | 30.3 | 1.5 | 131 | 29.6 | 5.6 | −9.2 | 6,000 | 200,000 |
| Comparative Example 3 | Comparative Magnetic Toner No. 3 | 34.6 | 12.2 | 128 | 31.4 | 4.8 | −13.5 | 7,000 | 250,000 |

COMPARATIVE EXAMPLE 3

According to the same method as in Example 3 except for using 0.5 parts of a monoazo compound chromium complex shown below in place of the compound No. 3, Comparative magnetic toner No. 3 with a volume average particle size of 11.5 μm was obtained.

EXAMPLE 4

Styrene-butyl acrylate-divinylbenzene copolymer (monomer weight ratio 70/30/1): 100 parts
Magnetic iron oxide (average particle size: about 0.2 μm): 55 parts
Compound No. 9 (average particle size: about 4 μm): 2 parts
Low molecular weight polypropylene: 3 parts After the above materials were preliminarily mixed, the mixture was roll milled on two rolls heated 15° to 150° C., and after cooling coarsely crushed by a cutter mill and pulverized by a pulverizer by use of jet air stream, and further classified by use of a wind classifier to obtain fine powder with a volume average particle size of 11 μm (magnetic toner No. 4). By mixing well 100 parts of the magnetic toner No. 4 with 0.4 part of hydrophobic collodial silica, a developer No. 4 was obtained. The physical properties of the magnetic toner No. 4 and the developer No. 4 are shown in Table 4.

By use of the developer No. 4, continuous copying test of 30,000 sheets was performed under normal temperature and normal humidity in a copying machine with copying speed of 50 sheets of A4 size paper per minute (commercially available under the trade name NP-7550, produced by Canon) to stably obtain images of high quality faithful to the original during the test. The density was maintained at 1.30 to 1.35, to give sharp images without fog recognized. Further, similar results were obtained under low temperature and low humidity of 10° C. and 10% RH, and under high temperture and high humidity of 30° C. and 80% RH.

The charged quantity was measured by blow-off (TB-200, produced by Toshiba Chemical Co.) after 1 g of the developer and 9 g of the iron powder carrier (200/300 mesh) were accurately weighed and thoroughly mixed.

COMPARATIVE EXAMPLE 4

In the same manner as in Example 4 except for using Comparative compound No. 2 in place of the Compound No. 9, Comparative toner No. 1 with a volume average particle size of 11 μm was prepared. By mixing 100 parts of Comparative toner No. 4 and 0.4 part of the hydrophobic colloidal silica, Comparative developer No. 4 was prepared.

COMPARATIVE EXAMPLE 5

In the same manner as in Example 4 except for using Comparative compound No. 3 in place of the Compound No. 9, Comparative toner No. 5 with a volume average particle size of 11 μm was prepared. By mixing 100 parts of Comparative toner No. 5 and 0.4 part of the hydrophobic colloidal silica, Comparative developer No. 5 was prepared.

By use of the developer No. 4 in Example 4, Comparative developer No. 4 in Comparative example 4 and Comparative developer No. 5 in Comparaive example 5, continuous copying tests were conducted under the environmental conditions of low temperature and low humidity (temperature 15° C., humidity 10% RH). The results are shown below in Table 3.

TABLE 3

| | Copied sheet number | | | | | |
|---|---|---|---|---|---|---|
| | Initial | | 1,000 sheets | | 10,000 sheets | |
| | Triboelectric Charges (μc/g) | Image Density | Triboelectric Charges (μc/g) | Image Density | Triboelectric Charges (μc/g) | Image Density |
| Inventive Developer No. 4 | −6 | 1.30 | −7 | 1.35 | −7 | 1.35 |
| Comparative Developer No. 4 | −7 | 1.30 | −10 | 1.20 | −10 | 1.15 |
| Comparative Developer No. 5 | −7 | 1.35 | −10 | 1.25 | −11 | 1.20 |

The triboelectric charges in the above Table are triboelectric charges in the developer on the sleeve in the developing region at the developing instrument in the copying machine.

As is apparent from the results in the Table, the developer No. 4 of the present invention is stable and triboelectric charges of the developer on the sleeve under low temperature and low humidity environment, and therefore small in fluctuation of the image density. In contrast, in the case of Comparative developers No. 4 and No. 5, when the number of copying becomes greater, triboelectric charges of the developer on the sleeve are increased whereby toner can be migrated with difficulty from the sleeve to the photosensitive drum, resulting in lowering of image density.

EXAMPLE 5

Styrene-butyl acrylate-divinylbenzene copolymer (monomer weight ratio 70/30/3): 100 parts Magnetic iron oxide (average particle size: about 0.2 μm): 55 parts Compound No. 5 (average particle size: about 4 μm): 2 parts Low molecular polypropylene: 3 parts.

After the above materials were premixed; the mixture was kneaded on two rolls heated to 150° C., and after cooling coarsely crushed by a cutter mill and pulverized by a pulverizer using jet air stream, and further classified by an air classifier to obtain fine powder with a volume average particle size of 11 μm (magnetic toner No. 5). By mixing sufficiently 100 parts of the magnetic toner No. 5 with 0.4 parts of hydrophobic colloidal silica a developer No. 5 was obtained. The physical properties of the toner No. 5 and the developer No. 5 are shown in Table 4.

By use of the developer No. 5, continuous copying test of 30,000 sheets was carried out under normal temperature and normal humidity by means of a copying machine (trade name: NP-250RE, produced by Canon) with copying speed of 25 sheets of A4 size papers per minute to obtain an image of high quality faithful to the original. As the result of copying test repeated for 30,000 sheets, good images which are faithful to the manuscript could be obtained stably during the test, and the density was maintained at 1.25 to 1.42, to give sharp images without fog. Further, similar results were obtained under low temperature and low humidity of 10° C. and 10% RH as well as under high temperature and high humidity of 30° C. and 80% RH.

The quantity of charges was measured by blow-off (TB-200, produced by Toshiba Chemical Co.) after 1 g of the developer No. 5 and 9 g of the iron powder carrier (200/300 mesh) were accurately weighed and thoroughly mixed.

EXAMPLE 6

TABLE 4

| | Magnetic Toner No. | Tetrahydrofuran Insolveles (%) | A Valve | Coercive Force (Oe) | Saturation Magnetizat-tion (emu/g) | Residual Magnetiza-tion (emu/g) | Charged Amount (μC/g) | Mn | Mw |
|---|---|---|---|---|---|---|---|---|---|
| | | | Properties of Respective Toners and Developers | Magnetic Characteristic (10KOe) | | | | Molecular Weight | |
| Example 4 | Magnetic Toner No. 4 | 35.4 | 1.5 | 118 | 29.2 | 4.1 | −12.3 | 4,500 | 210,000 |
| Example 5 | Magnetic Toner No. 5 | 36.2 | 1.4 | 114 | 28.4 | 3.9 | −13.0 | 4,500 | 210,000 |
| Example 6 | Magnetic Toner No. 6 | 33.9 | 1.9 | 121 | 25.9 | 5.1 | −11.5 | 4,000 | 150,000 |
| Comparative Example 4 | Comparative Magnetic Toner No. 4 | 34.8 | 1.7 | 119 | 27.7 | 3.8 | −13.5 | 4,500 | 210,000 |
| Comparative Example 5 | Comparative Magnetic Toner No. 5 | 36.7 | 1.6 | 120 | 29.5 | 4.0 | −11.2 | 4,500 | 210,000 |
| Comparative Example 6 | Comparative Magnetic Toner No. 6 | 35.4 | 1.5 | 115 | 28.0 | 4.1 | −8.9 | 4,500 | 200,000 |

Styrene-2-ethylhexyl acrylate-divinylbenzene copolymer (monomer weight ratio 80/20/2): 100 parts
Magnetic iron oxide (average particle size: about 0.2 μm): 55 parts
Compound No. 6 (average particle size: about 4 μm): 2 parts
Low molecular polypropylene: 3 parts A magnetic toner No. 6 was obtained according to the same method as in Example 5 except for using the above materials. 100 parts of the magnetic toner No. 6 was mixed with 0.4 parts of hydrophobic colloidal silica to prepare a developer No. 6. The physical properties of the toner No. 6 and the developer No. 6 are shown in Table 4.

When intermittent printout test was carried out for 3,000 sheets by means of a commercially available laser beam printer (trade name: LLBP-CX, produced by Canon), sharp images with density of 1.23 to 1.39 and without fog were obtained. Further, similar tests were carried out under the conditions of 15° C. and 10% RH, and of 30° C. and 85% RH to obtain similar results.

COMPARATIVE EXAMPLE 6

Comparative magnetic toner No. 6 and Comparative developer No. 6 were obtained according to the same method as in Example 5, except for using 2 parts of dimethylsalicylic acid chromium complex shown below in place of the compound No. 5.

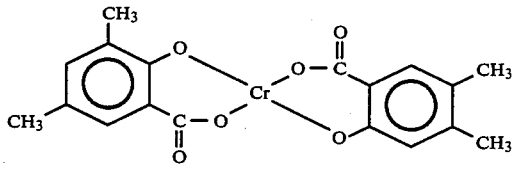

As the result of copying test conducted in the same manner as in Example 5, good results were obtained similarly as in Example 5 under normal temperature and normal humidity, however, under the environments of low temperature and low humidity, and under high temperature and high humidity, slight lowering in density (1.08 to 1.21) and fog were observed, which were particularly conspicuous during supplementing of toner.

The magnetic toner of the present invention can be used for a developing toner for visualizing electrostatic images in the image forming method such as the electrophotographic method, the electrostatic recording method and the electrostatic printing method known in the art, and has excellent effects as mentioned below.

(1) Triboelectric charges are uniform among magnetic toner particles, and the amount of charges can be controlled easily. During continuous usage for a long term, or depending on the environment, the amount of triboelectric charges is not varied or reduced to give a stable magnetic toner.

(2) The magnetic toner is not influenced by humidity and can give particularly stable images also under low humidity.

(3) The magnetic toner is not influenced by temperature to give stable images.

(4) The magnetic toner is excellent in humidity excellent in durability, to give constantly stable images when used continuously for a long term.

(5) The magnetic toner is excellent in resolving power, to give every time images of high quality with high density without fog.

What is claimed is:

1. A toner for developing electrostatic latent images comprising:

100 parts by weight of a binder resin containing 70% by weight or less of a tetrahydrofuran insoluble component and a tetrahydrofuran soluble component having an acid value of 50 or less;

20 to 200 parts by weight of magnetic powder; and 0.01 to 10 parts by weight of a compound represented by the following formula (III), (IV) or (VI):

(III)

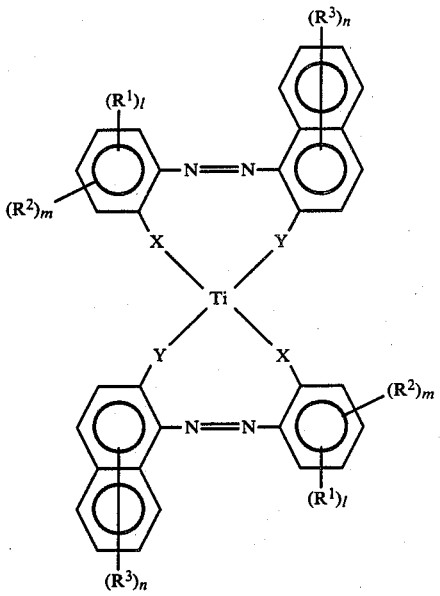

wherein $R^1$ is an alkyl group having 1 to 18 carbon atoms, an alkenyl group having 2 to 18 carbon atoms, an aralkyl group having 7 to 18 carbon atoms or an aryl group having 6 to 18 carbon atoms; $R^2$ is a hydrogen, a halogen, a nitro group, or an alkoxy group having 1 to 18 carbon atoms; $R^3$ is a hydrogen, a halogen, a nitro group, a carboxyl group, an anilide group, an alkyl having 1 to 18 carbon atoms, an alkenyl group having 2 to 18 carbon atoms, an aralkyl group having 7 to 18 carbon atoms, an aryl group having 6 to 18 carbon atoms, an alkoxy group having 1 to 18 carbon atoms or a carboxyester group having 2 to 18 carbon atoms; X and Y each are —O—, —COO—, —S— or —$NR^4$, where $R^4$ is an alkyl having 1 to 4 carbon atoms; C is hydrogen, sodium, potassium, ammonium or organic ammonium; $l$ is 1 or 2; m and n each are 1, 2, or 3; with the proviso that when the phenylene group or naphthylene group in the formula (III) has plural substituents, they may be either the same or different;

(IV)

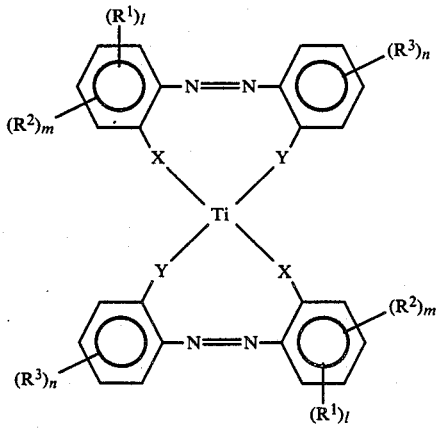

wherein $R^1$ is an alkyl group having 1 to 18 carbon atoms, an alkenyl group having 2 to 18 carbon atoms, an aralkyl group having 7 to 18 carbon atoms or an aryl group having 6 to 18 carbon atoms; $R^2$ is a hydrogen, a halogen, a nitro group, or an alkoxy group having 1 to 18 carbon atoms; $R^3$ is a hydrogen, a halogen, a nitro group, a carboxyl group, an anilide group, an alkyl having 1 to 18 carbon atoms, an alkenyl group having 2 to 18 carbon atoms, an aralkyl group having 7 to 18 carbon atoms, an aryl group having 6 to 18 carbon atoms, an alkoxy group having 1 to 18 carbon atoms or a carboxyester group having 2 to 18 carbon atoms; X and Y each are —O—, —COO—, —S— or —$NR^4$, where $R^4$ is an alkyl having 1 to 4 carbon atoms; C is hydrogen, sodium, potassium, ammonium or organic ammonium; $l$ is 1 or 2; m and n each are 1, 2, or 3; with the proviso that when the phenylene group in the formula (IV) has plural substituents, they may be either the same or different; and (VI)

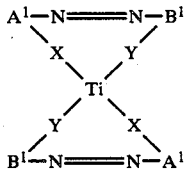

wherein $A^1$ is a phenylene group, which may have a substitutent selected form the group consisting of a nitro group, a halogen atom or an alkoxy group having 1 to 18 carbon atoms; $B^1$ is a phenylene residue or naphthylene residue which may have a substituent selected from the group consisting of a nitro group, a halogen atom, a carboxyl group, an anilide group, an alkoxy group having 1 to 18 carbon atoms or a carboxylester group; X and Y each are —O—, —COO—, —S— or —NR— where R is hydrogen or an alkyl having 1 to 4 carbon atoms; C is hydrogen, sodium, potassium, ammonium or organic ammonium; with the proviso that when $A^1$ and $B^1$ has plural substituents, they may be either the same or different.

2. A toner according to claim 1, wherein the binder resin contains 10 to 70% by weight of a tetrahydrofuran insoluble component.

3. A toner according to claim 1, wherein the magnetic powder is contained in an amount of 40 to 150 parts by weight per 100 parts by weight of the binder resin.

4. A toner according to claim 3, wherein the magnetic powder has an average particle size of 0.1 to 2 μm.

5. A toner according to claim 2, wherein the magnetic powder imparts magnetic characteristics of coercive force of 20 to 150 Oersted, saturated magnetization of 50 to 200 emu/g and residual magnetization of 2 to 20 emu/g to the toner by application of 10K Oersted.

6. A toner according to claim 5, wherein the saturated magnetization is 50 to 100 emu/g.

7. A toner according to claim 1, which has a volume average particle size of 5 to 15 μm.

8. A toner according to claim 1, wherein the binder resin contains 30 to 90% by weight of a component soluble in tetrahydrofuran, and said soluble component has an acid value of 50 or less.

9. A toner according to claim 8, wherein the tetrahydrofuran soluble component in the binder resin has an acid value of 25 or less.

10. A toner according to claim 8, wherein the tetrahydrofuran soluble component has a number average molecular weight (Mn) of 2,000 to 20,000 and a weight average molecular weight of 50,000 to 3,000,000.

11. A toner according to claim 1, wherein the binder resin contains 10 to 60% by weight of the tetrahydrofuran insoluble component.

12. A toner according to claim 1, wherein the binder resin contains 10 to 50% by weight of the tetrahydrofuran insoluble component.

13. A toner according to claim 1, wherein the binder resin comprises a crosslinked styrene type copolymer.

14. A toner according to claim 13, wherein the binder resin comprises a styrene-α-methylene aliphatic monomer alkyl carboxylate-divinylbenzene copolymer or a styrene-alkyl acrylate-divinylbenzene copolymer.

15. A toner according to claim 1, which is mixed with 0.1 to 3% by weight of hydrophobic colloidal silica fine powder.

16. A toner for developing electrostatic latent images, comprising:

100 parts by weight of a binder resin containing 70% by weight or less of a tetrahydrofuran insoluble component and a tetrahydrofuran soluble component having an acid value of 50 or less;

20 to 200 parts by weight of magnetic powder; and 0.01 to 10 parts by weight of a compound represented by the following formula (I) or (II),

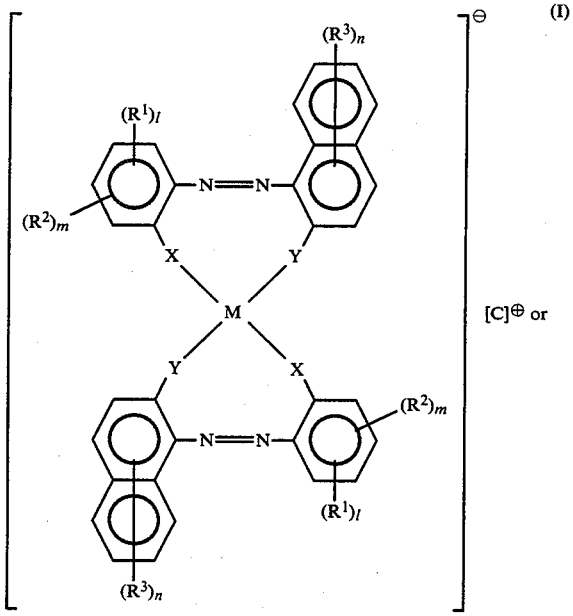

(I)

-continued

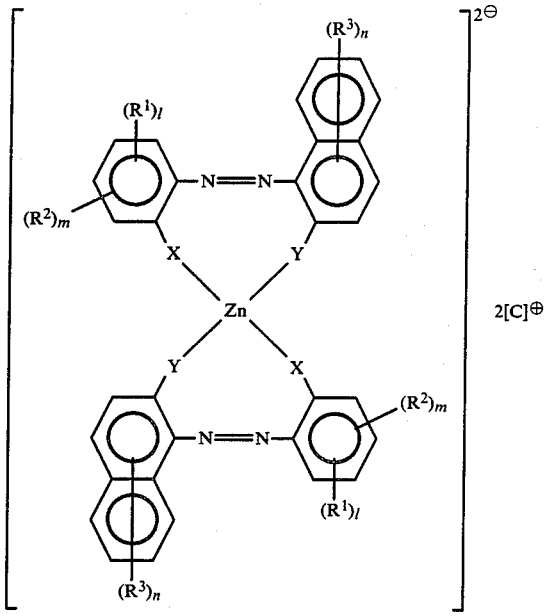

wherein $R^1$ is an alkyl group having 1 to 8 carbon atoms; $R^2$ is a hydrogen, a halogen, a nitro group, or an alkoxy having 1 to 18 carbon atoms; $R^3$ is a hydrogen, a halogen, a nitro group, a carboxyl group, an anilide group, an alkyl having 1 to 18 carbon atoms, an alkenyl group having 2 to 18 carbon atoms, an aralkyl group having 7 to 18 carbon atoms, an aryl group having 6 to 18 carbon atoms, an alkoxy group having 1 to 18 carbon atoms or a carboxyester group having 2 to 18 carbon atoms; X and Y each are —O—, —COO—, —S— or $NR^4$ where $R^4$ is an alkyl having 1 to 4 carbon atoms; M is scandium, vanadium or manganese; C is hydrogen, sodium, potassium, ammonium or organic ammonium; $l$ is 1 or 2; m and n each are 1, 2 or 3; with the proviso that when the phenylene group or naphthylene group in the formula (I) has plural substituents, they may be either the same or different; or

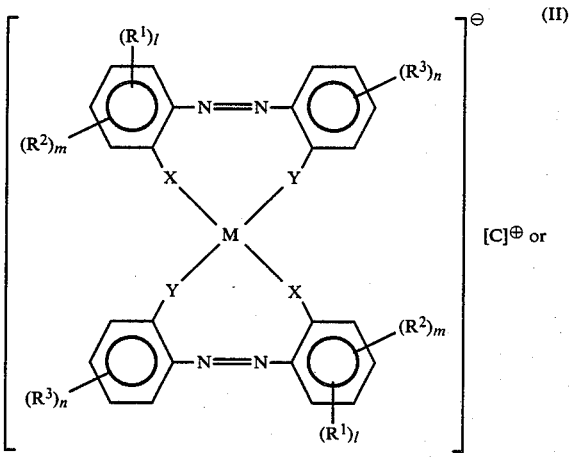

(II)

-continued

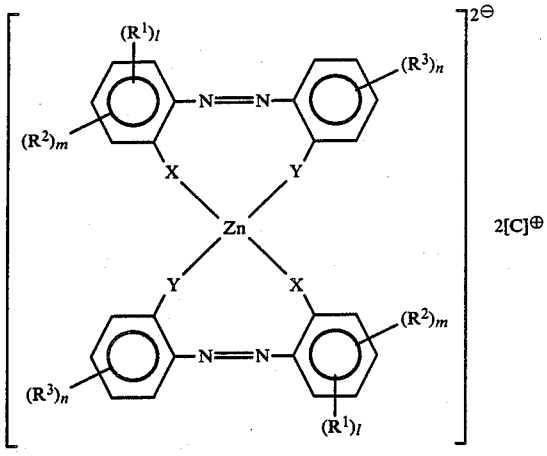

where $R^1$ is an alkyl group having 1 to 8 carbon atoms; $R^2$ is a hydrogen, a halogen, a nitro group, or an alkoxy having 1 to 18 carbon atoms; $R^3$ is a hydrogen, a halogen, a nitro group, a carboxyl group, an anilide group, an alkyl having 1 to 18 carbon atoms, an alkenyl group having 2 to 18 carbon atoms, an aralkyl group having 7 to 18 carbon atoms, an aryl group having 6 to 18 carbon atoms, an alkoxy group having 1 to 18 carbon atoms or a carboxyester group having 2 to 18 carbon atoms; X and Y each are —O—, —COO—, —S— or —$NR^4$— where $R^4$ is an alkyl having 1 to 4 carbon atoms; M is scandium, vanadium or manganese; C is hydrogen, sodium, potassium, ammonium or organic ammonium, *l* is 1 or 2; m and n each are 1, 2 or 3; with the proviso that when the phenylene group in the formula (II) has plural substituents, they may be either the same or different.

17. A toner according to claim 16, wherein the binder resin contains 10 to 70% by weight of the tetrahydrofuran insoluble component.

18. A toner according to claim 16, wherein $R^1$ is an alkyl group having 4 to 8 carbon atoms.

19. A toner according to claim 16, wherein $R^2$ is a chlorine atom or nitro group.

20. A toner according to claim 16, wherein the magnetic powder is contained in an amount of 40 to 150 parts by weight per 100 parts by weight of the binder resin.

21. A toner according to claim 16, wherein the magnetic powder has an average particle size of 0.1 to 2 μm.

22. A toner according to claim 21, wherein the magnetic powder imparts magnetic characteristics of coercive force of 20 to 150 Oersted, saturated magnetization of 50 to 200 emu/g and residual magnetization of 2 to 20 emu/g to the toner by application of 10K Oersted.

23. A toner according to claim 22, wherein the saturated magnetization is 50 to 100 emu/g.

24. A toner according to claim 16, which has a volume average particle size of 5 to 15 μm.

25. A toner according to claim 16, wherein the binder resin contains 30 to 90% by weight of a component soluble in tetrahydrofuran, and said soluble component has an acid value of 50 or less.

26. A toner according to claim 25, wherein the tetrahydrofuran soluble component in the binder resin has an acid value of 25 or less.

27. A toner according to claim 16, wherein the tetrahydrofuran soluble component has a number of average molecular weight (Mn) of 2,000 to 20,000 and a weight average molecular weight of 50,000 to 3,000,000.

28. A toner according to claim 16, wherein the binder resin contains 10 to 60% by weight of the tetrahydrofuran insoluble component.

29. A toner according to claim 28, wherein the binder resin contains 10 to 50% by weight of the tetrahydrofuran insoluble component.

30. A toner according to claim 16, wherein the binder resin comprises a crosslinked styrene type copolymer.

31. A toner according to claim 30, wherein the binder resin comprises a styrene-α-methylene aliphatic monomer alkyl carboxylate-divinylbenzene copolymer or a styrene-alkyl acrylate-divinylbenzene copolymer.

32. A toner according to claim 16, which is mixed with 0.1 to 3% by weight of hydrophobic colloidal silica fine powder.

* * * * *

UNITED STATES PATENT AND TRADEMARK OFFICE

CERTIFICATE OF CORRECTION

PATENT NO. : 4,857,432

DATED : August 15, 1989

INVENTOR(S) : HIROHIDE TANIKAWA ET AL.

It is certified that error appears in the above-identified patent and that said Letters Patent is hereby corrected as shown below:

COLUMN 1

Line 29, "as" should read --a--.
Line 60, "trielectric" should read --triboelectric--.

COLUMN 2

Line 6, "tone" should read --toner--.

COLUMN 3

Line 4, "substitutents" should read --substituents--.

COLUMN 5

Line 27, "crbon" should read --carbon--.
Line 55, "18 atoms" should read --18 carbon atoms--.
Line 68, "fo" should read --to--.

COLUMN 7

Line 3, "Compound No. 3" should read --⊖ Compound No. 3--.

COLUMN 13

Line 20, "(reractory indec)" should read --(refractory index)--.
Line 45, "(W 1 g)" should read --(W 1g)--.

UNITED STATES PATENT AND TRADEMARK OFFICE

CERTIFICATE OF CORRECTION

PATENT NO. : 4,857,432

DATED : August 15, 1989

INVENTOR(S) : HIROHIDE TANIKAWA ET AL.

It is certified that error appears in the above-identified patent and that said Letters Patent is hereby corrected as shown below:

COLUMN 14

Line 4, "cyinder" should read --cylinder--.
Line 10, "accumulate" should read --accumulated--.

COLUMN 16

Line 4, "rati-" should read --ratio--.
Line 5, "o=80/15/5/0.6): 100 parts" should read --=80/15/5/0.6): 100 parts--.

COLUMN 17

Line 34, "A Valve " should read --A Value --.

COLUMN 18

Line 67, "15°" should be deleted.

COLUMN 20

Line 4, "and" should read --in--.
Line 23, "premixed;" should read --premixed,--.

COLUMN 22

Line 53, "humidity" should read --humidity,--.
Line 54, "durability," should read --durability--.

UNITED STATES PATENT AND TRADEMARK OFFICE

CERTIFICATE OF CORRECTION

PATENT NO. : 4,857,432

DATED : August 15, 1989

INVENTOR(S) : HIROHIDE TANIKAWA ET AL. Page 3 of 3

It is certified that error appears in the above-identified patent and that said Letters Patent is hereby corrected as shown below:

COLUMN 24

Line 29, "form" should read --from--.

Signed and Sealed this

Fifth Day of November, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,857,432

DATED : August 15, 1989

INVENTOR(S) : Hirohide Tanikawa, et al.

It is certified that error appears in the above-identified patent and that said Letters Patent is hereby corrected as shown below:

[57] ABSTRACT:

Line 6, change "formula" to --formula:--

COLUMN 1:

Line 40, change "method," to --methods,--.

Line 45, change "miniturization" to --miniaturization--.

COLUMN 2:

Line 67, change "atoms;" to --atoms);--.

COLUMN 3:

Line 35, change "These compounds" to --The compound--.

Line 52, change "preferably" to --preferable--.

Line 53, change "comounds" to --compounds--.

Line 59, change "preferable" to --preferably--.

UNITED STATES PATENT AND TRADEMARK OFFICE
CERTIFICATE OF CORRECTION

PATENT NO. : 4,857,432

DATED : August 15, 1989

INVENTOR(S) : Hirohide Tanikawa, et al

It is certified that error appears in the above-identified patent and that said Letters Patent is hereby corrected as shown below:

COLUMN 5:

Line 18, "R1" should read --$R^1$--.

COLUMN 7:

Line 45, change "compound No. 6" to --compound No. 5--

COLUMN 10:

Line 63, change "acrylonitorile, methacrylonitorile," to --acrylonitrile, methacrylonitrile,--.

COLUMN 11:

Line 9, change "divinylbenzen" to --divinylbenzene--.

UNITED STATES PATENT AND TRADEMARK OFFICE

CERTIFICATE OF CORRECTION

PATENT NO. : 4,857,432

DATED : August 15, 1989

INVENTOR(S) : Hirohide Tanikawa, et al.

It is certified that error appears in the above-identified patent and that said Letters Patent is hereby corrected as shown below:

COLUMN 11:

Line 29, change "maghemaite," to --maghemite,--.

Line 31, change "meals" to --metals--.

Line 65, change "carunauba" to --carnauba--, and "etc" to --etc.--.

COLUMN 12:

Line 32, change "dispenser" to --disperser--.

Line 51, change "measured" to --is measured--.

COLUMN 13:

Line 15, change "5.1x104, 1.1x105," to --$5.1 \times 10^4$, $1.1 \times 10^5$--.

Line 16, change "3.9x105, 8.6x105, 2x106," to --$3.9 \times 10^5$, $8.6 \times 10^5$, $2 \times 10^6$--.

UNITED STATES PATENT AND TRADEMARK OFFICE

CERTIFICATE OF CORRECTION

PATENT NO. : 4,857,432

DATED : August 15, 1989

INVENTOR(S) : Hirohide Tanikawa, et al

It is certified that error appears in the above-identified patent and that said Letters Patent is hereby corrected as shown below:

COLUMN 16:

Line 3, change "Styrene-butylmethacrylatemonobutyl" to --Styrene-butylmethacrylate-monobutyl--.

Line 42, change "parts" to --part.--.

COLUMN 17:

Table 2 (2nd column heading), change "Insolveles" to --Insolubles--.

COLUMN 19:

Line 20, change "perture" to --perature--.

Line 46, change "Comparaive" to --Comparative--.

COLUMN 21:

Table 4, (2nd column heading), change "Insolveles" to--Insolubles--.

Table 4, (3rd column heading), change "Valve" to --Value.

COLUMN 22:

Line 53, delete "excellent in humidity".

COLUMN 25:

Line 40, change "(II)," to --(II):--.

Signed and Sealed this

Thirty-first Day of December, 1991

*Attest:*

HARRY F. MANBECK, JR.

*Attesting Officer* *Commissioner of Patents and Trademarks*